US006518853B1

(12) United States Patent
O'Connell

(10) Patent No.: US 6,518,853 B1
(45) Date of Patent: Feb. 11, 2003

(54) WIDEBAND COMPACT LARGE STEP CIRCULAR WAVEGUIDE TRANSITION APPARATUS

(75) Inventor: John B. O'Connell, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/947,580

(22) Filed: Sep. 6, 2001

(51) Int. Cl.[7] ..... H01P 5/02; H01P 1/16

(52) U.S. Cl. ..... 333/21 R; 333/34; 333/35; 333/248

(58) Field of Search ..... 333/21 R, 34, 333/35, 26, 248, 208, 147, 245

(56) References Cited

U.S. PATENT DOCUMENTS 4,163,961 A * 8/1979 Woodward ..... 333/261
4,672,388 A * 6/1987 Grim ..... 343/786
5,202,648 A 4/1993 McCandless
5,227,744 A * 7/1993 Sabatier ..... 333/21 R
5,414,394 A 5/1995 Gammand et al.
5,426,200 A 6/1995 Dauth et al.
5,461,283 A 10/1995 Thornber et al.
6,057,804 A * 5/2000 Kaegebein ..... 343/792

* cited by examiner

*Primary Examiner*—Brian Young
*Assistant Examiner*—John Nguyen
(74) *Attorney, Agent, or Firm*—Harness, Dickey & Pierce, P.L.C.

(57) ABSTRACT

An apparatus for forming a quarter wave step between a waveguide of a radiating element under test and a waveguide associated with test equipment being used to test the radiating element. The apparatus includes a housing including a first bore, a second bore and a third bore, with the second bore forming a quarter wave step between the first and third bores. A pair of circuit boards each including a ring resonator are disposed at the transition areas between the first and second bores and the second and third bores. The ring resonators cancel the reactive component that would otherwise be introduced into the propagating wave as it travels through the quarter wave step portion of the apparatus. The apparatus is relatively short in length and easily implemented in a test environment to test various microwave components.

15 Claims, 2 Drawing Sheets

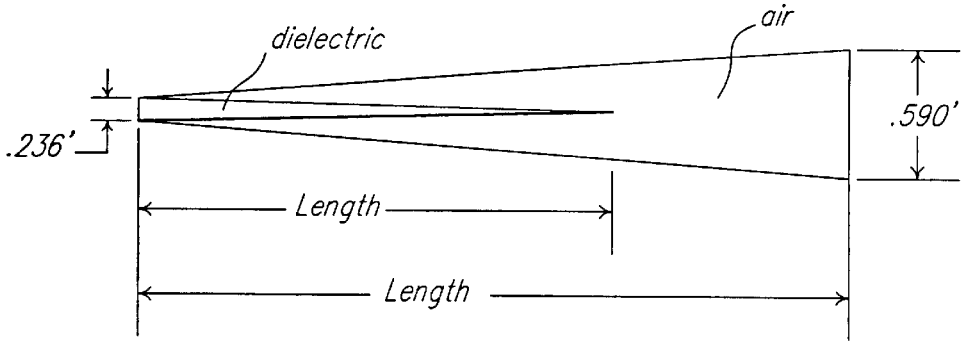
FIG. 1. Prior Art
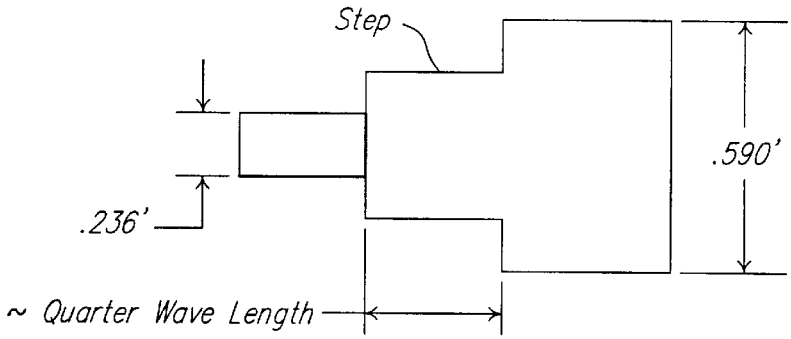
Prior Art FIG. 2.
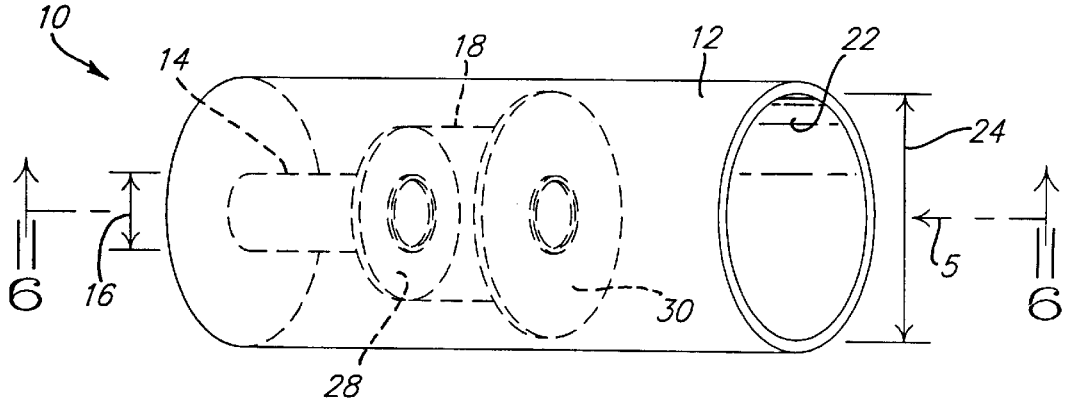
FIG. 3.

WIDEBAND COMPACT LARGE STEP CIRCULAR WAVEGUIDE TRANSITION APPARATUS

FIELD OF THE INVENTION

This invention relates to waveguides, and more particularly to an apparatus for interfacing a first diameter waveguide to a second diameter waveguide, where the second diameter waveguide has a larger diameter than the first, and without causing reflections of a wave propagating through the apparatus from the first to the second waveguides.

BACKGROUND OF THE INVENTION

In a microwave communication system, microwave signals generally must travel through many different types of transmission lines and waveguide structures as they propagate between an input and an output port. All of these different types of propagating media have advantages and disadvantages in and of themselves and in their ability to interface to other parts of a microwave communication system. The other parts of the microwave communication system may include antennas, printed microwave circuitry, and machined waveguide circuitry.

A specific problem that arises in transmitting microwave signals is when the microwave signal must propagate from a small diameter waveguide to a large diameter waveguide. One specific application where this problem arises is in connection with the testing of presently designed phased array antenna modules. One such phased array antenna module is manufactured by The Boeing Co. With this antenna module, each radiating element of the module is constructed as a circular, dielectric loaded waveguide having a diameter of approximately 0.236 inch (6 mm). However, test equipment required to interface to the circular waveguide of each radiating element requires a circular waveguide having a diameter of approximately 0.590 inch (14.97 mm). A microwave transition is therefore required to transfer electromagnetic energy to and from the waveguide used to interface with the test equipment.

A general restraint on this design is the need for minimum length to separate the two waveguides. It is preferred that this transition length be as short as possible to facilitate ease of test setup. One particular method of solving this problem would be to construct a long taper between the loaded small diameter waveguide and the larger unloaded waveguide. This is illustrated in FIG. 1. However, this method is presently not possible using current available dielectric material because of the brittle nature of such presently available material. The brittle nature of such material prevents the needed cone shape with a sharp tip from being machinable. Because of this, the tapered approach to solving the above-described problem has not been pursued.

Even if suitable dielectric material was available which allowed manufacturing of a cone shaped portion of dielectric with a very sharp tip, other problems would likely have been encountered in implementing this solution. The first problem would be to maintain the correct cutoff frequency of the dominant mode TE11 versus the taper angle. If the taper angle is too severe verses the increasing diameter (i.e., 0.236 inch to 0.590 inch), then at some point along the length of the transition the cutoff frequency would be above the operational frequency. Thus, the signal would not be able to propagate past this point. Even if a successful taper angle could be found, the length of the dielectric would produce a transition distance that would be too long to be practical for use in present day test environments.

A second design approach which has been considered is a series of quarter wave steps. One such quarter wave step is shown in FIG. 2. This approach, however, is only successful when the step transitions do not have a large reactive component. In a transition with large steps such as that shown in FIG. 2, the reactance is large. This produces an impedance mismatch resulting in reflection of the propagating wave through the step portion.

Accordingly, some form of apparatus is needed which acts as a transition between two waveguides, where one waveguide has a smaller diameter than the other, and which does not cause any reflections of the propagating wave as it propagates through the apparatus.

It would further be highly desirable to provide an apparatus which forms a transition between a first waveguide and a second waveguide, where the second waveguide has a larger diameter than the first waveguide, and where a propagating wave is able to pass through the apparatus without being reflected, and further where the apparatus forms a very small distance which makes it suitable for use in test environments as an interface between two such waveguides of different diameter.

SUMMARY OF THE INVENTION

The present invention is directed to an apparatus for forming a transition between a waveguide having a first diameter and a waveguide having a second diameter, where the second diameter is larger than the first diameter, and which allows a microwave signal to propagate therethrough without causing reflections of the propagating wave. The apparatus further accomplishes this with a short overall length which makes the apparatus suitable for use with present day test equipment being used to test present day phased array antennas, where the phased array antenna includes a plurality of radiating elements each having a circular waveguide associated therewith.

The apparatus of the present invention forms a quarter wave step but without producing the reactive components typically associated with quarter wave step matching devices. The quarter wave step of the present invention is formed, in one preferred form, from a section of material which has a first diameter bore formed therethrough. A second bore is formed concentrically with the first bore and has a diameter larger than the first bore, and sufficient to form the quarter wave step. A third bore is formed in the apparatus concentrically with the first and second bores. The third bore has a third diameter. The first diameter matches the diameter of the circular waveguide of the radiating element being tested. The third diameter matches the diameter of the waveguide associated with the test equipment. A first ring resonator is disposed within the second diameter adjacent the point where the first diameter transitions into the second diameter. A second ring resonator is disposed at the point of transition between the second diameter and the third diameter. In a preferred embodiment, each of the ring resonators are formed on separate circular printed circuit boards which are placed within the apparatus. The ring resonators cancel the reactive component introduced by the quarter wave step which prevents reflections of a propagating wave being caused as it passes through the quarter wave step.

In a preferred embodiment of the present invention the apparatus is formed from a single block of metallic material such as aluminum. The first bore forms a first waveguide and is preferably filled with a dielectric material. The second bore forms the quarter wave step and is preferably filled with a dielectric material with a different dielectric constant than the first waveguide. The third diameter forms a second waveguide and is also air filled. Advantageously, the apparatus is relatively short in length and therefore well suited for use in a test environment when interfacing a waveguide associated with a radiating or receiving element of a phased array antenna with test equipment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a side view of a cone shaped dielectric having a taper which leads to a small point, illustrating the difficulty and impracticality of manufacturing such a dielectric to serve as a transition between two waveguides, where one waveguide has a diameter larger than the other;

FIG. 2 is a view of a prior art quarter wave step transition for interfacing two waveguides having different diameters;

FIG. 3 is a perspective view of an apparatus in accordance with a preferred embodiment of the present invention for forming a quarter wave step transition for matching a first waveguide to a second waveguide, where the second waveguide has a larger diameter than the first waveguide;

DETAILED DESCRIPTION OF THE PREFERRED EMBODIMENTS

The following description of the preferred embodiment(s) is merely exemplary in nature and is in no way intended to limit the invention, its application, or uses.

Figure 6:
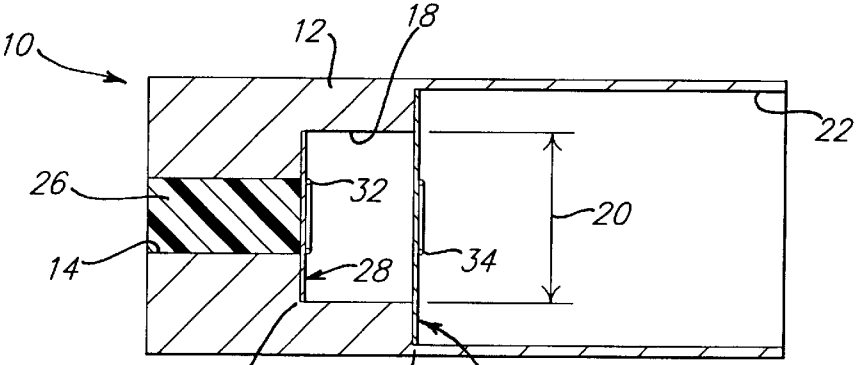
FIG. 6 is a cross sectional side view of the apparatus taken in accordance with section line 6—6 in FIG. 3.
Figure 5:
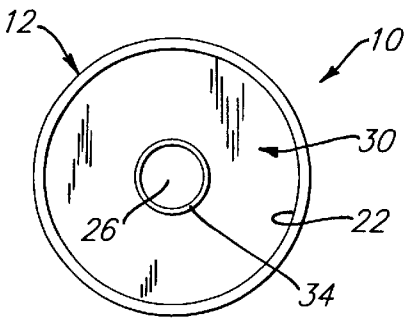
FIG. 5 is an end view of the apparatus of FIG. 3 taken in accordance with direction line 5 in FIG. 3.

Referring to FIGS. 3 and 6, there is shown a matching apparatus 10 in accordance with a preferred embodiment of the present invention. The apparatus 10 includes a housing 12 which is preferably formed from a single block of metallic material such as aluminum. Other materials such as gold or brass may also be suitable as alternative materials. The housing 12 includes a first bore 14 having a first diameter 16 which forms a first waveguide for interfacing with a waveguide of a radiating element of a phased array antenna. A second bore 18 is formed concentrically and in communication with the first bore 14 and has a second diameter 20 which is larger than the first diameter 16. The second bore 18 essentially forms a quarter wave step or matching area. A third bore 22 has a third diameter 24 which matches (i.e., interfaces) the apparatus 10 to test equipment being used to test the phased array antenna. The third bore 22 is concentric and in communication with both the first bore 14 and the second bore 18 as illustrated in FIG. 5. The bore 18 can also be filled with a dielectric piece of material (not shown) to maintain a desired physical property, such as a cut-off frequency, as the diameter of the bore 18 gets smaller. It is anticipated that the smallest waveguide (i.e., formed by first bore 14) will be filled with a dielectric 6 material and that the bore 18 (forming the quarter wave step) will be filled with a dielectric of 2.5.

Figure 4:
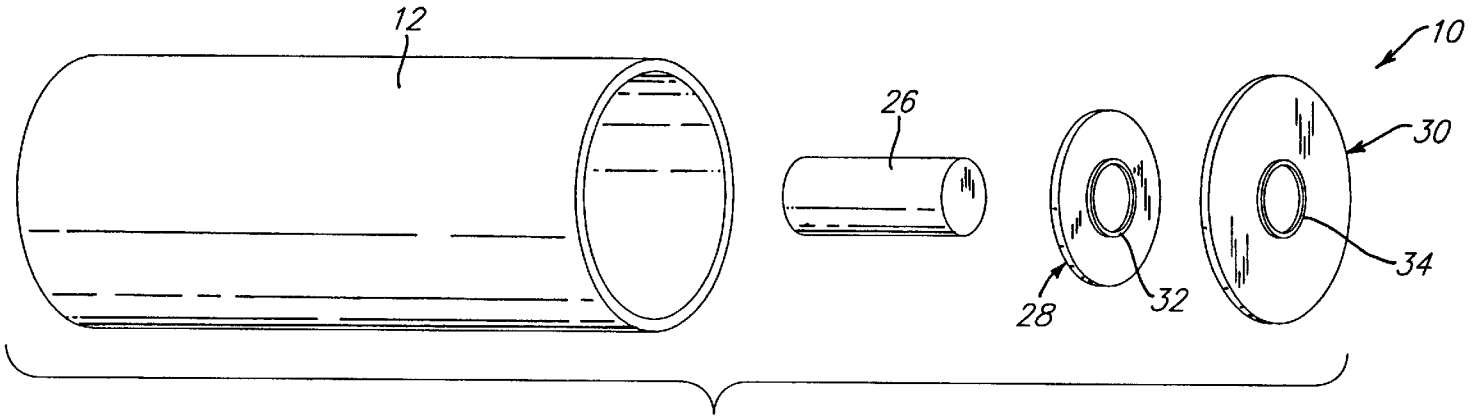
FIG. 4 is an exploded perspective view of the components of the apparatus of FIG. 3.

Referring to FIGS. 4 and 6, the interior construction of the apparatus 10 can be seen in greater detail. With specific reference to FIG. 4, the apparatus 10 includes a block of dielectric material 26 which is of a diameter and length suitable to fill the first bore 14. A first circuit board 28 is disposed in the second bore 18 and a second circuit board 30 is disposed in the third bore 22. The first circuit board 28 includes a ring resonator 32 formed thereon and the second circuit board 30 also includes a ring resonator 34 formed thereon. The specific diameter of each of the ring resonators 32 and 34 is selected to eliminate the reactance which would otherwise be caused by the second bore 18 acting as the quarter wave step impedance matching section. A discussion of ring resonators can be found in N. Marcuvitz, *Waveguide Handbook*, P. Peregrinus, Ltd. (1986) (ISBN 086341 058 8), which is hereby incorporated by reference into the present application. The diameter of each of ring resonators 32 and 34 may vary significantly, depending on the specific application. The dielectric block 26 may also be made from a variety of dielectric materials but in one preferred form is made from a dielectric 6 material.

Referring specifically to FIG. 6, the first circuit board 28 is disposed within the second bore 18 at a first transition area 36 between the first bore 14 and the second bore 18. The second circuit board 30 is disposed at a second transition area 38 defining the transition between the second bore 18 and the third bore 22. It will be appreciated that the circuit boards 28 and 30 could just as readily be disposed within the first bore 14 and the second bore 18, respectively, provided they are positioned at the transition areas 36 and 38. The circuit boards 28 and 30 may be held within the apparatus 10 by mechanical fasteners or suitable adhesives. Alternatively, and in actual practice, it is anticipated that at least a small degree of space will need to be included between the circuit boards 28 and 30 and their respective transition areas 36 and 38 such that the circuit boards do not rest directly against the wall portions forming the steps at these transition areas. This is to allow the needed tuning of the apparatus 10. Still further, for tuning purposes, if a dielectric material is inserted in the second bore 18, a portion of it (e.g., one-third) could be inserted into the first bore 14 and a second portion (e.g., two-thirds) inserted into the second bore 18.

As a microwave propagates into the first bore 18, which essentially forms a first waveguide, it propagates through the circuit board 28 and the ring resonator 32 into the second bore 18. It then propagates through the circuit board 30 and the ring resonator 34 into the third bore 22. The ring resonators 32 and 34 serve to cancel the reactive component that would be introduced by the second bore 18 acting as the quarter wave step. This substantially or entirely eliminates any reflections that would otherwise be introduced by the presence of the second bore 18 acting as the quarter wave step.

While the apparatus 10 has been described as being formed from a single section of metallic material such as aluminum, it will be appreciated that the apparatus could be formed from two or more sections suitable materials secured together.

A particular advantage of the apparatus 10 is that it occupies a relatively short length in forming a transition between a waveguide of a radiating element under test and the test equipment used to test it. In one preferred form the overall length of the apparatus 10 is no more than about 1 inch (25.4 mm).

The apparatus 10 thus forms a relatively easy to manufacture, low cost and easy to implement structure for forming a quarter wave step between a waveguide of a radiating element of a phased array antenna and a waveguide associated with test equipment being used to test the antenna. The apparatus 10 can be manufactured cost effectively and with a relatively small number of independent component parts, thereby allowing it to be assembled quickly and easily. It can be used to interface a wide range of microwave products to test instruments, and is therefore not limited to use with just antennas.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for interfacing a first waveguide to a second waveguide, where the first waveguide has a smaller diameter than the second waveguide, to eliminate reflections caused as a propagating wave transitions between said first and second waveguides, the apparatus comprising:

a first bore adapted to be mated to said first waveguide, said first bore having a first diameter approximately equal to said first waveguide;

a second bore formed concentrically with said first bore and in communication with said first bore, said second bore having a second diameter larger than said diameter of said first bore;

a first, generally circular conductor disposed within one of said first and second bores adjacent a first point of transition between said first and second bores;

a third bore formed concentrically with said second bore and in communication with said second bore, said third bore having a third diameter approximately equal to said second waveguide, said third bore further being adapted to be mated to said second waveguide;

a second, generally circular conductor disposed within one of said second and third bores adjacent a second point of transition between said second and third bores; and wherein said second bore forms a quarter wave step transition and said first and second generally circular conductors serve to at least substantially eliminate a reactive component that would otherwise be introduced by said quarter wave step transition.

2. The apparatus of claim 1, further comprising:

a first printed circuit board;

wherein said first generally circular conductor is formed on a surface of said first printed circuit board; and wherein said first printed circuit board is disposed within said second bore closely adjacent said first point of transition between said first and second bores.

3. The apparatus of claim 1, further comprising:

a second printed circuit board;

wherein said second generally circular conductor is formed on a surface of said second printed circuit board; and wherein said first printed circuit board is disposed within said second bore closely adjacent said second point of transition between said second and third bores.

4. The apparatus of claim 1, wherein said apparatus is formed from a single piece of metal.

5. The apparatus of claim 1, wherein said apparatus is formed from a single block of aluminum.

6. The apparatus of claim 1, wherein said first bore is filled with dielectric material.

7. An apparatus for interfacing a first waveguide to a second waveguide, where the first waveguide has a smaller diameter than the second waveguide, to eliminate reflections caused as a propagating wave transitions between said first and second waveguides, the apparatus comprising:

a housing;

a first bore formed in said housing and adapted to be mated to said first waveguide, said first bore having a first diameter approximately equal to a diameter of said first waveguide;

a second bore formed in said housing concentrically with said first bore and in communication with said first bore, said second bore having a second diameter larger than said first diameter of said first bore;

a first, generally circular conductor disposed on a first printed circuit board, said first printed circuit board being disposed within one of said first and second bores adjacent a transition point between said first and second bores;

a third bore formed in said housing concentrically with said second bore and in communication with said second bore, said third bore having a third diameter approximately equal to a diameter of said second waveguide, said third bore further being adapted to be mated to said second waveguide;

a second, generally circular conductor disposed on a second printed circuit board, said second printed circuit board being disposed within one of said second and third bores adjacent a transition point between said second and third bores; and wherein said second bore forms a quarter wave step transition and said first and second generally circular conductors serve to at least substantially eliminate a reactive signal component that would otherwise be introduced by said quarter wave step transition.

8. The apparatus of claim 7, wherein said apparatus is formed from a single piece of metal.

9. The apparatus of claim 7, wherein said apparatus is formed from a single piece of aluminum.

10. The apparatus of claim 7, further comprising a dielectric material placed within said first bore so as to at least substantially fill said first bore.

11. An apparatus for interfacing a first waveguide to a second waveguide, where the first waveguide has a smaller diameter than the second waveguide, to eliminate reflections caused as a propagating wave transitions between said first and second waveguides, the apparatus comprising:

a length of material having a bore extending therethrough, a diameter of said bore being greater than a diameter of said first waveguide but less than a diameter of said second waveguide, said length of material forming a quarter wave step for forming a path for a propagating wave travelling within said first waveguide to said second waveguide;

a generally circular first conductor placed adjacent a first end of said length of material concentric with said first waveguide and said bore;

a generally circular second conductor placed adjacent a second end of said length of material concentric with said bore and said second waveguide;

said generally first and second conductors operating to cancel a reactive signal component that would otherwise be introduced into said propagating wave as said propagating wave passes through said length of material into said second waveguide, thereby substantially eliminating reflections within said length of material.

12. The apparatus of claim 11, further comprising a first circuit board, and wherein said first conductor is formed on said first circuit board.

13. The apparatus of claim 11, further comprising a second circuit board, and wherein said second conductor is formed on said second circuit board.

14. The apparatus of claim 11, wherein said length of material comprises a metallic material.

15. The apparatus of claim 11, wherein said length of material comprises aluminum.

* * * * *